United States Patent [19]

Ray

[11] 4,284,089

[45] Aug. 18, 1981

[54] SIMULATED SMOKING DEVICE

[76] Inventor: Jon P. Ray, 12544 Judson Rd., San Antonio, Tex. 78233

[21] Appl. No.: 136,420

[22] Filed: Apr. 2, 1980

Related U.S. Application Data

[63] Continuation of Ser. No. 947,373, Oct. 2, 1978, abandoned.

[51] Int. Cl.[3] ..... A24F 47/00

[52] U.S. Cl. ..... 131/270; 128/202.21

[58] Field of Search ..... 131/8 A, 10.1, 170 A, 131/170 R, 261 A, 10.3, 10.5; 128/202.21

[56] References Cited

U.S. PATENT DOCUMENTS

| | | | |
|---|---|---|---|
| 2,445,476 | 7/1948 | Folkman | 128/202.21 |
| 2,860,638 | 11/1958 | Bartolomeo | 128/202.21 |
| 3,320,953 | 5/1967 | Rindner | 131/170 A |
| 3,347,231 | 10/1967 | Chang | 131/170 A |
| 3,404,692 | 10/1968 | Lampert | 128/202.21 X |
| 3,683,936 | 8/1972 | O'Neil, Jr. | 131/170 A X |

FOREIGN PATENT DOCUMENTS

| | | | |
|---|---|---|---|
| 276250 | 6/1967 | Australia | 131/170 A |

*Primary Examiner*—Stephen C. Pellegrino
*Attorney, Agent, or Firm*—Arnold, White & Durkee

[57] ABSTRACT

A simulated smoking device, adapted for non-burning or non-combustion uses, comprises: a container defining a passageway therethrough; a source of vaporizable nicotine in fluid communication; and means for preventing the evaporation of said nicotine during periods of non-use. The source of vaporizable nicotine may be an absorbent material which has a nicotine-bearing material absorbed therein. The absorbent may also have absorbed therein a pH adjustment, water and/or flavoring ingredients. The device, at ambient temperatures and pressures, releases nicotine vapors into air drawn through the passageway of the container during use.

34 Claims, 5 Drawing Figures

FIG. 1
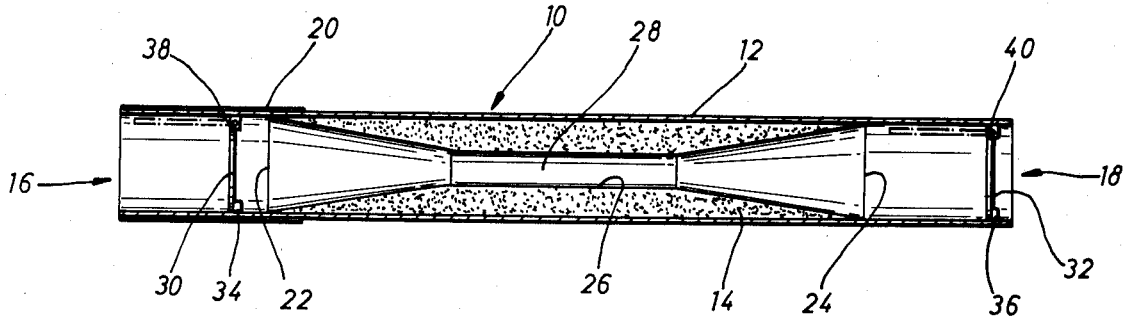
FIG. 2
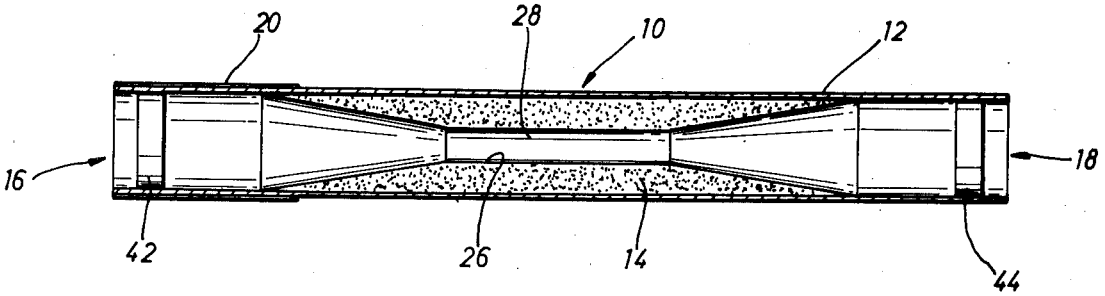
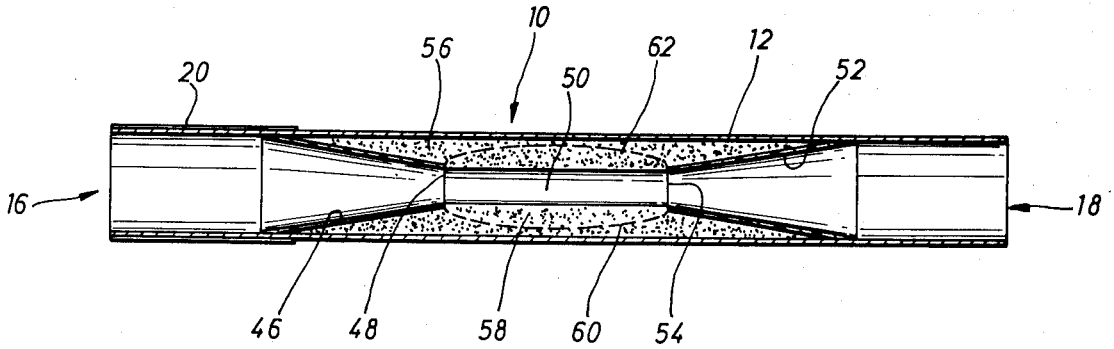
FIG. 3

FIG. 4
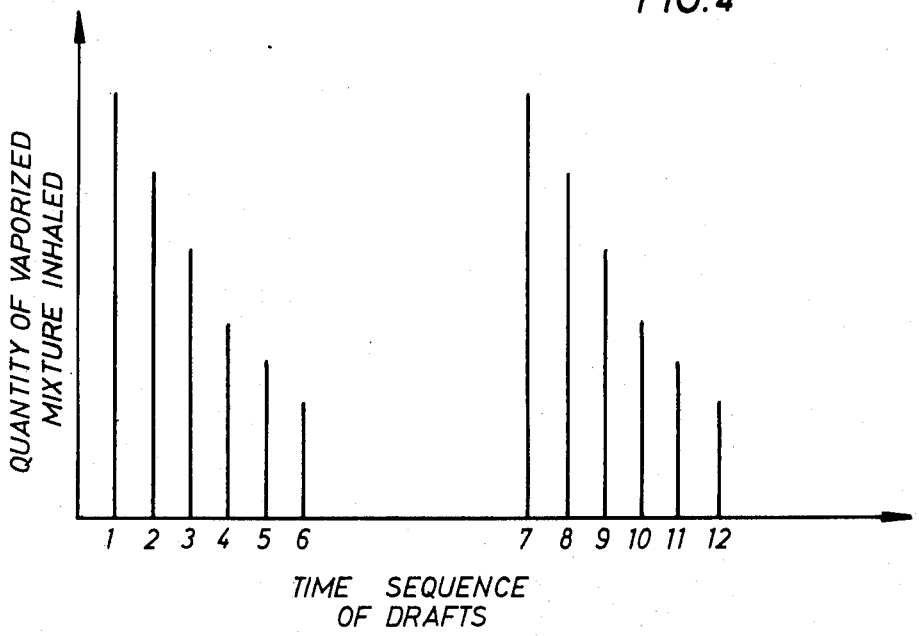
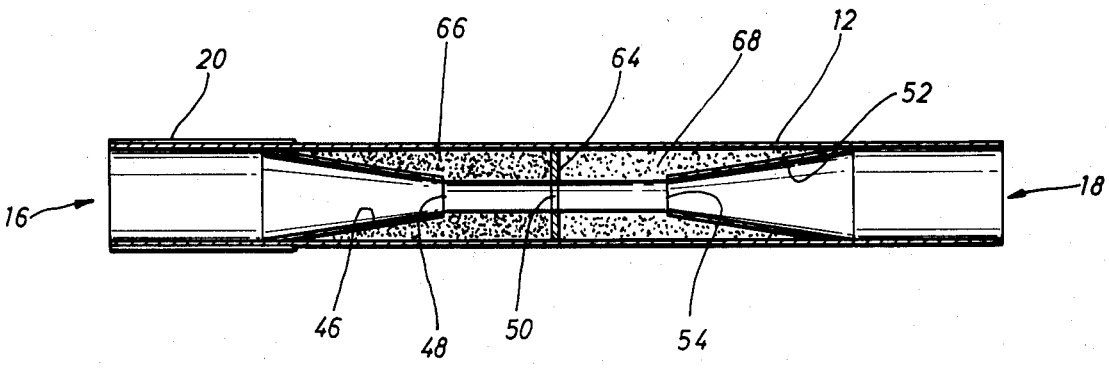
FIG. 5

SIMULATED SMOKING DEVICE

This is a continuation of application, Ser. No. 947,373, filed Oct. 2, 1978 now abandoned.

BACKGROUND OF THE INVENTION

This invention relates to non-combustible cigarettes designed to reduce or eliminate the disadvantages associated with conventional smoking habits using combustible cigarettes.

The use of nicotine has long been practiced by persons in many cultures, who derive satisfaction from the substance. Nicotine is a toxic liquid alkaloid having the formula $C_5H_4NC_4H_7NCH_3$. When the nicotine is obtained from tobacco, as by chewing, sniffing, or smoking the substance, the amount of nicotine absorbed into the body generally does not build up to a harmful dose, but produces certain pleasurable effects, frequently leading to habitual use.

One of the most popular versions of nicotine use involves the smoking of cigarettes. When the tobacco in a conventional cigarette is ignited, the combustion of the processed tobacco leaves within the cigarette causes the release of vaporous nicotine, which is drawn through the cigarette and into the user's mouth and lungs when the user sucks or inhales air through the cigarette.

The relative mildness of a cigarette, as compared to a pipe or cigar, permits a user to draw the smoke from the burning cigarette directly into the lungs. The nicotine vapors in the cigarette smoke are rapidly assimilated into the bloodstream of the user from the lungs, so that cigarette smoking provides a method by which a user may very quickly feel the effects of the nicotine.

Although nicotine can thus be readily introduced into the body through cigarette smoking, the combustion of the tobacco, with the consequent elevated temperatures required in this process, unfortunately result in a number of undesirable consequences associated with smoking combustible cigarettes. Of primary concern are the serious health hazards known to result from smoking combustible cigarettes. Although the nicotine content of a cigarette is not believed to cause any serious adverse long term health effects on the human body, many other components which are harmful are present in tobacco smoke. Some of these other constituents are known carcinogens, for example. A table listing some of the harmful components in tobacco smoke may be found on pp. 496–501 of the publication Tobacco and Tobacco Smoke, Studies in Experimental Carcinogenesis (1967) by Ernest L. Wynder and Dietrich Hoffman of the Sloan-Kettering Institute for Cancer Research. The teaching of that publication is hereby incorporated by reference into this application. Furthermore, the smoking of combustible cigarettes may pose a significant fire hazard. Many fires which have occurred both within buildings and in natural environments have been attributable to burning cigarettes which were carelessly discarded. In addition, substantial economic losses can be attributed to smoking, including significant damage to business and personal property resulting from burns in clothing, carpeting, furniture, etc. caused by stray ashes from cigarettes. Cigarette smoking has also become increasingly objectionable because of the discomfort it may cause to nonsmokers who are exposed to the smoke and odor produced by the smoking habit.

Because of these undesirable side effects of combustible cigarette smoking, attempts have been made from time to time to provide an acceptable substitute for combustible cigarette smoking which will eliminate or ameliorate the adverse consequences mentioned above. Tobacco concentrates, for example, have been processed into a tablet form which may be sucked or chewed in the mouth of the user, the nicotine being absorbed into the user's body through the lining of the mouth. Such a tablet, of course, does not provide the user with the feel of a cigarette between his or her lips. Furthermore, a tablet smoking substitute cannot provide the user with an opportunity to draw air and vapors into the mouth nor inhale that air and vapors into the lungs, which is an essential part of the conventional smoking habit. These activities constitute an important aspect of the psychological and physiological affinity which a smoker acquires for the habit. Without an effective substitute for such smoking activities, a tablet form of tobacco is likely not to satisfy the smoker and may thus result in a return to combustible cigarette smoking.

In another approach to providing a substitute for smoking, it has been recognized that processed tobacco, such as that contained in cigarettes, will release vapors even when it is heated to a temperature lower than the ignition point of the tobacco. Thus, a smoker might draw air through such heated tobacco and thereby obtain the vapors which are released in conventional smoking without also inhaling the noxious by-products of tobacco combustion. Devices manufactured according to this technique, however, have sometimes used a second isolated portion of tobacco, which is ignited, as the source of heat. Although such a device is chambered so that the products of combustion are not directly inhaled by the user in the act of drawing air through such a device, the harmful by-products of combustion are nevertheless released into the air surrounding the user. Thus, substantial amounts of the deleterious combustion by-products may nevertheless be inhaled by the user and surrounding persons through breathing the ambient air. In addition, with such a substitute device, substantially the same fire hazards are presented as with conventional smoking devices, and there remains the potential for burn damage to carpets, furniture, clothing, etc. Alternatively, the tobacco in this method may be heated by various pyrophorous materials, which are mixed together with the tobacco. Such materials react with oxygen, alcohol, water, etc. and thereby produce sufficient heat to cause the tobacco to release vapors. With this technique, however, any by-products of the combustion reaction, which occurs within the tobacco mix, will also tend to be inhaled through the device by the user. Thus, there is the danger of adverse health consequences resulting whenever any of these by-products are toxic or otherwise harmful. Furthermore, the structure of such devices tend to be unduly complex, resulting in a relatively high manufacturing cost.

Various other smoking substitutes have been developed which include cigarette simulating devices containing various materials which approximate the taste and aroma of tobacco or release various other additional aromatic vapors which are intended to have a satisfying effect on the user when those vapors are inhaled. In one such device, synthetic materials simulating the taste and aroma of tobacco are micro-encapsulated within a cigarette substitute device. The desired vapors are released by squeezing or crushing the device, causing the capsules to burst and the vapors to be released into the air drawn through the device. In another such device, the flavor and taste components of tobacco are saturated within a capsule containing an absorbent material, and, when punctured, the capsule releases the aroma and flavor volatiles of tobacco into the air drawn through the device. These devices, however, have failed to take into account that the primary physiological phenominon related to cigarette smoking, which must be provided in any effective substitute, is the sudden introduction of nicotine vapor into the user's lungs to satisfy the user's habit.

Thus, despite the various attempts which have been made to provide effective substitutes for combustible cigarettes, no one has developed a device which permits the user to inhale controlled amounts of nicotine vapors, free of all known or suspected carcinogens, sufficient to satisfy a nicotine habit without the need for combustion or other heating means and without the need for the user taking some unfamiliar action other than the actions performed in the conventional smoking habit, namely drawing or sucking a gaseous mixture through a cigarette and inhaling that gaseous mixture into the lungs of the user.

Therefore, a need has developed for a substitute for combustible cigarettes which will release nicotine vapors into the air drawn through the substitute by a smoker without the need for any heating means or any action on the user's part other than drawing air through the cigarette as is done with a conventional cigarette.

Furthermore, it would be advantageous to provide such a non-combustible cigarette with a means by which various flavoring agents, moisturizers, and pH controlling agents might be added to adjust the desired qualities of the vapor inhaled from the device.

In addition, it would be advantageous to provide a noncombustible cigarette in which the static evaporation of the nicotine material and the dilution of the nicotine material by exposure to moisture may be prevented.

It would also be advantageous to provide a non-combustible cigarette in which the sequential concentrations of nicotine vapor released can be controlled and programmed according to the rate of repeated inhalations and the time between periods of repeated inhalations.

It would be advantageous as well to provide a non-combustible cigarette in which multiple vaporizable mixtures having incompatible characteristics can be separately stored so that the multiple vapors can be combined in the air drawn through the device.

SUMMARY OF THE INVENTION

This invention provides a simulated smoking device which is adapted for non-burning or non-combustion uses. This device, hence, provides the user with the nicotine desired from for example, a conventional cigarette without the need of either burning, causing combustion or having to somehow elevate the temperature of to cause the vaporization of nicotine from tobacco. The device comprises a container defining a passageway therethrough and a source of vaporizable nicotine in fluid communication with the passageway such that nicotine vapors are released into air drawn through the passageway by the user. The source of vaporizable nicotine may comprise an absorbent material having absorbed therein a nicotine-bearing material. The device should be provided with means to prevent the evaporation of nicotine when the device is not in use. The means may include means, such as flaps, which are pressure responsive such that no nicotine is permitted to evaporate when the device is not in use but, in use, nicotine is evaporated into air drawn through the passageway by the user.

The device may include a constriction within the passageway which is formed by the absorbent material. The device may also include a means containing a source of vaporizable nicotine, which means is disposed within the container and providing for the reduction of pressure of air drawn through the passageway.

The non-combustible cigarette of this invention includes a container defining a passageway therethrough, an absorbent member disposed within the container and communicating with the passageway, a nicotine mixture disposed within the absorbent member, and a constriction within the passageway which communicates with the absorbent member, the cigarette thereby being adapted to release vapors from the mixture into air drawn through the passageway by a user. The nicotine mixture within the cigarette may be selected from the group consisting of nicotine (d), nicotine (l), nicotine (dl), nicotine salts, and nicotine esters. The nicotine mixture may further include orange flavoring, lemon flavoring, menthol, spearmint flavoring, peppermint flavoring, cinnamon flavoring, or other ingredients for flavoring and pH adjustment of the mixture, and water to adjust the humidity of the vapors released.

The cigarette may additionally include a closure at each end of the passageway, each closure comprising a resilient flap affixed to the container and adapted to seal the passageway during periods of nonuse, while yielding to allow air to be drawn through the passageway by the user. The cigarette may further include moisture seals at either end of the passageway, which comprise a porous plug disposed across the passageway, the plug being adapted to provide minimal resistance to the flow of gases therethrough yet prevent the flow of liquids therethrough.

In a preferred embodiment, the container is cylindrical in shape, with an outer diameter, a length, and a weight, selected to simulate the appearance of a conventional cigarette. The cigarette may further include a cylindrical band affixed around a first end of the cylinder, the band being adapted to simulate the appearance of a filtertip.

In a more particular embodiment, the absorbent member of the cigarette comprises an absorbent cylinder with an external diameter corresponding to the inner diameter of the container, whose ends are recessed from the ends of the container, thereby preventing contact between the absorbent member and the mouth of a person using the device.

In another more particular embodiment, the passageway of the cigarette comprises a first tapered portion bounded by a first frustoconical sidewall and tapering inward from a first end of the container, a second tapered portion bounded by a second frustoconical sidewall and tapering inward from a second end of the container, and a central cylindrical portion which communicates between the first portion and the second portion, the sidewall of the central portion being defined by the absorbent member. In this embodiment, the diameter and length of the central portion may be selected to provide a predetermined rate of vapor release from the absorbent mixture.

In a still more particular embodiment, an annular divider is disposed between the container and the central portion, and the absorbent member further comprises a first absorbent member disposed within the volume defined by the container, the first sidewall, the central portion and the divider, and a second absorbent member disposed within the volume defined by the container, the second sidewall, the central portion and the divider, the first and second absorbent members thereby permitting the inclusion within the cigarette of two mixtures having incompatible characteristics. In this embodiment, the divider may be longitudinally positioned within the cylinder so as to control the relative amounts of surface area of the first and second absorbent members which are exposed to the passageway, thereby controlling the relative amounts of vapor which will be released from the first and second absorbent members. Furthermore, in this embodiment, the relative porosities of the first and second absorbent members may be selected to provide additional control over the relative amounts of vapor which are released from the first and second members.

Examples of the more important features of this invention have thus been broadly outlined in order that the detailed description which follows may be better understood, and so that the contributions which this invention provides to the art may be better appreciated. There are, of course, additional features of the invention which will be described herein and which will be included within the subject matter of the claims appended hereto.

BRIEF DESCRIPTION OF THE DRAWINGS

Additional objects, features, and advantages of the present invention will become apparent by referring to the following detailed description of the preferred embodiments in connection with the accompanying drawings, wherein like reference numerals refer to like elements throughout all the figures. In the drawings:

FIG. 1 is a side elevation in longitudinal section which illustrates one embodiment of a non-combustible cigarette constructed according to the present invention.

FIG. 2 is a side elevation in longitudinal section illustrating a second embodiment of a non-combustible cigarette constructed according to the present invention.

FIG. 3 is a side elevation in longitudinal section illustrating a third embodiment of a non-combustible cigarette constructed according to the present invention.

FIG. 4 is a graphical representation illustrating a typical concentration sequence of inhaled vapors which may be obtained through use of the device illustrated in FIG. 3.

FIG. 5 is a side elevation in longitudinal section illustrating a fourth embodiment of a non-combustible cigarette constructed in accordance with the present invention.

DESCRIPTION OF THE PREFERRED EMBODIMENTS

Now referring to the drawings, and first to FIG. 1, one embodiment of the present invention is illustrated in a cross sectional side elevation. The non-combustible cigarette 10 includes a container 12 and an absorbent member 14, which is saturated with a nicotine mixture. When a user places the mouth end 16 of the device between his lips and inhales through the device, as with a conventional cigarette, air is drawn into the intake end 18 of the cigarette. The air drawn through the device picks up vapors from the nicotine mixture and then passes into the user's mouth, throat, and lungs where the nicotine vapors are absorbed into the user's body.

Now referring to the structure of the device 10 in more detail, the container 12 is constructed in a cylindrical shape of a material which is chemically inert with respect to the nicotine mixture contained in the absorbent member 14. Suitable materials for container 12, for example, include aluminum, glass, and teflon. In a preferred embodiment of the invention, the container 12 is manufactured with a diameter, length, and weight which approximate the size of a conventional cigarette. Furthermore, the container may be provided with the appropriate color to present the same appearance as a cigarette. In addition, a band 20, made of paper, cork, or another suitable material, may be applied around the mouth end 16 of the device to simulate the appearance of the filter tip on a conventional cigarette. By thus making the device similar in appearance to a conventional cigarette, the appeal of this device as a substitute for a combustible cigarette will be enhanced, since the user may thus psychologically tend to feel as if he or she is handling and using a familiar smoking product.

The absorbent member 14 is provided in the form of an internally tapered cylinder having an external diameter corresponding to the inner diameter of the container 12. The ends 22 and 24 of the member 14 are recessed from the ends of the container, thereby preventing contact between the user and the nicotine mixture which is contained within the absorbent member 14. The inner wall 26 of the absorbent member 14 defines a tubular passageway 28, which is designed to present a constriction in cross sectional area to air which is drawn through the device 10. According to an outstanding feature of this invention, this constriction in the path of the air flowing through the device operates to promote effective vaporization of the nicotine mixture without the need for combustion or heating. According to the venturi principle, when a flowing gas is forced through a passageway having a reduced cross sectional area, the velocity of the gas will increase within the constriction and the pressure of the gas will be reduced at that point. The reduced pressure will allow any liquid exposed to the low pressure area to more readily transfer to the vapor or gaseous phase and be absorbed into the gas.

Because of the constricted tubular passageway 28, when air is drawn through the cigarette 10 by the sucking action of a user on the mouth end 16, that air will increase in velocity and decrease the local pressure within the passageway 28. Thus, the liquid nicotine mixture contained within the absorbent member 14 will tend to evaporate into the air passing through the tubular passageway 28, whereas such a nicotine mixture will not normally evaporate sufficiently at room temperature and pressure. Because of its use of this venturi principle, the present invention enables the construction of a practical non-combustible cigarette which will transfer sufficient quantities of nicotine vapor into the inhaled airstream to satisfy a user accustomed to smoking combustible cigarettes.

It has been found that a number of substances may be advantageously provided in the nicotine mixture which is placed in absorbent member 14. Nicotine (d), nicotine (l), nicotine (dl), nicotine salts, and nicotine esters may all be used to advantage in this mixture to provide the nicotine vapors which are inhaled by the user. 98 percent nicotine (l), a product obtained from Eastman, stock number 1242, has been used in one embodiment of the device and found to perform with satisfactory results. A preparation of nicotine hydrochloride with a pH of 7 has also been successfully employed. A number of other materials have been found to provide advantageous results when added to the nicotine mixture. Orange oil obtained from commercial orange extract by distilling to remove the alcohol, or similarly obtained lemon oil, enhance the flavoring of the vapor produced from the cigarette and also assist in adjusting the mixture to the proper pH when added to the nicotine mixture. Such flavoring may also be added in the form of synthetic ingredients. Other flavors which may advantageously be used in the cigarette include spearmint, peppermint, and cinnamon.

The pH of the mixture should be adjusted to approximately a pH of 7 so as to be close to the pH of the human body and thereby avoid any excessively alkaline or acidic taste to the vapors drawn through the cigarette. Menthol may also be added to the mixture for flavoring, as in conventional cigarettes. The menthol which has been used is U.S.P. Levorotatory, obtained from the Gentry Corporation, and is dissolved in ethanol to form a liquid. In addition, water may be added to the absorbent member 14. The water vapor which thus evaporates into the air drawn through the device helps to humidify the air and thus reduce the slight feeling of dry mouth which may be experienced after prolonged use of the device without the addition of such water.

In a specific example of this invention which was manufactured, a length of 9/32" outside diameter thin-wall aluminum tubing was cut to a length of 3 inches. The outside surface of the tubing was covered with a white adhesive paper, with one end covered a distance of $\frac{7}{8}$" with a wood grained adhesive paper.

A piece of qualitative grade filter paper, of medium speed, was then cut to a trapezoidal shape having a large base two inches in length, a short base $\frac{3}{4}$ inches in length, and sides $4\frac{3}{4}$ inches in length. The filter paper was rolled up and inserted into the tubing, the 2 inch base being placed next to the inner wall of the tubing, thus forming a central opening tapering to approximately 3/32 inch in diameter.

The filter paper was then saturated with 300 milligrams of 98% nicotine, Eastman number 1242, and 200 milligrams of a flavoring agent consisting of distilled orange oil. The cigarette thus constructed was found to permit an air volume of approximately 500 milliliters to be drawn over a two second period, thereby providing a low draw resistance for direct lung inhalation of nicotine vapors. Alternatively, if a noncombustible cigarette is to be provided with a draw resistance approximating that of a conventional, combustible cigarette, the filter paper should be cut to a larger size to further restrict the passageway and reduce the total air volume drawn over a two second period to approximately 35 milliliters. It has been found that approximately 100 micrograms of nicotine will be vaporized over a two second draw on the latter embodiment.

It has been found that a number of variables in the construction of the non-combustible cigarette affect the quantity of nicotine which will be vaporized into a given volume of air drawn through the device. Among these factors are the extent of saturation of the absorbent member 14 with the nicotine mixture, the porosity of the absorbent member, the diameter and length of the absorbent member, the vapor pressure of the nicotine mixture, and the velocity and the amount of air drawn through the passageway 28. All of these variables may be adjusted through experimentation to obtain a suitable ratio of the nicotine mixture vapors to the air inhaled by the user.

It is contemplated that a number of different materials having suitable absorbency might be used to advantage for the absorbent member 14. Two such materials which have been found to provide satisfactory performance in this device, however, are high quality laboratory filter paper, as mentioned in the example above, and laboratory extraction thimble material.

It has been found that when the cigarette 10 is in a static condition, i.e., no air is being drawn through the device, the vapor pressure of a typical nicotine mixture is such that very little evaporation of the mixture contained in the absorbent member 14 occurs. Should the prevention of any such evaporation be desirable, however, an optional feature may be provided to seal the cigarette during periods of nonuse. As shown in FIG. 1, sealing flaps 30 and 32 are positioned within the mouth end 16 and the intake end 18 of the container 12, respectively. Seats 34 and 36 are affixed around the periphery of the interior of the container 12, and, when the sealing flaps 30 and 32 rest against the seats 34 and 36, airflow into or out of the passageway 28 is substantially prevented, thereby minimizing any evaporation of the nicotine mixture contained within the absorbent member 14. The sealing flaps 30 and 32 are affixed to the container 12 at attachment points 38 and 40, respectively. The flaps are constructed of a suitable pliable or elastomeric material, such as rubber impregnated cloth, which will yield and be held in approximately the positions shown by the dotted lines in FIG. 1 when air is drawn through the device 10 by the sucking action of a user's mouth applied to the mouth end 16 of the device. With the flaps 30 and 32 drawn into the positions shown by the dotted lines, air may flow readily through the device, permitting vapors from the nicotine mixture to pass into the air and thence into the user's body.

Now referring to FIG. 2, a second embodiment of the invention is shown in a cross sectional side elevation. The device 10 of FIG. 2 is similar to that shown in FIG. 1, including a container 12 and an absorbent member 14, which is adapted to receive a nicotine mixture, with a tubular passageway 28 passing through the absorbent member 14. In some applicatons, it may be desirable to provide the cigarette with a means for preventing leakage of the nicotine mixture in the event the device is exposed to moisture. Toward that end, the cigarette 10 shown in FIG. 2 is provided with moisture plugs 42 and 44 mounted in the mouth end 16 and the intake end 18 of the container 12, respectively. The plugs 42 and 44 are manufactured of a highly porous material which will normally allow air to flow freely therethrough. When the plugs are exposed to moisture, however, they will absorb some if the moisture and expand, closing the pores therein and thereby preventing the moisture from contacting the absorbent member 14. In this manner, the nicotine mixture within the absorbent member 14 is prevented from leaking out should the cigarette 10 be exposed to moisture. One material which has been found to perform adequately when used for plugs 42 and 44 is balsa wood. It is believed, however, that other similar materials are available which will also suffice to be used as plugs 42 and 44.

Now referring to FIG. 3, a third embodiment of a cigarette manufactured in accordance with the present invention is illustrated in a cross sectional side elevation. As with the embodiments shown in FIGS. 1 and 2, the cigarette 10 in FIG. 3 includes a cylindrical container 12, which may include a band 20 around one end thereof, the container being shaped and colored so that the device simulates the appearance of a conventional cigarette. Within the container 12, a first tapered nonporous sidewall 46 is affixed to the interior of the container 12 at its wider end and tapers to a narrow end where it defines the exit 48 of the central passageway 50. A similarly constructed second tapered nonporous sidewall 52 is attached at its broad end to the intake end 18 of this container 12, and tapers to a narrow end where it forms the intake 54 of the central passageway 50. The absorbent member 56 is disposed in this embodiment within the container 12 in the space defined by the container and the first and second tapered sidewalls 46 and 52. Furthermore, a central passageway 50, which is tubular in shape, extends through the center portion of the absorbent member 56.

As in the embodiments of the invention illustrated in FIGS. 1 and 2, a nicotine mixture is added to the absorbent member 56. The particular design of the cigarette in FIG. 3, however, is arranged so that the performance characteristics of the device may be effectively controlled. When the device 10 is in a static condition, i.e., no air has been recently drawn through the central passageway 50, the nicotine mixture will tend to be evenly distributed throughout the absorbent member 56. When an initial puff of air is drawn through the device, however, the vaporization of some of the nicotine mixture into the air passing through the central passageway 50 will temporarily reduce the concentration of the nicotine mixture within the area of the absorbent member 56 which is close to the central passageway 50, i.e., a central volume 58 of the absorbent member 56 which is approximately toroidal in shape, as indicated by the dotted lines 60 and 62 in FIG. 3.

When the concentration of nicotine mixture within the central volume 58 is reduced by a draft on the cigarette, the nicotine mixture absorbed within the remaining portions of the absorbent member 56 will tend to move into the volume 58 and equalize in concentration throughout the absorbent member. If the next draft on the cigarette, however, occurs within a relatively short period of time after the first draft, the concentration of the nicotine mixture within the central volume 58 will remain reduced to some degree. Thus, the amount of nicotine mixture evaporated into the second draft of air will tend to be less than the corresponding amount for the first draft. When a series of repeated drafts is taken through the device, with relatively short time intervals between those drafts, the concentration of the nicotine mixture released into the air will thus be progressively reduced for each subsequent draft. Consequently, the amount of nicotine which a user may receive by inhaling through the cigarette of FIG. 3 within a given period of time is limited. This arrangement may be used to ensure that the amount of nicotine absorbed into the user's body does not build up to a harmful level.

Once the user terminates a series of drafts on the device and leaves the device 10 idle for a longer period of time, the central volume 58 within the absorbent member 56 will be recharged with the nicotine mixture as the concentration of nicotine mixture within the absorbent member 10 tends to equalize over the whole volume of the absorbent member. Thus, when the user takes a subsequent draft through the cigarette after a sufficient time delay, the nicotine received in the first draw of the second sequence will approximate the concentration which was provided in the first draft. In this manner, the device may be provided with a relatively large quantity of nicotine mixture within the absorbent member 56, so that the cigarette may be used over a relatively long period of time, simulating a large number of "smokes" before depleting, while at the same time the user will not receive an excessive amount of nicotine within any one "smoke".

This controlled concentration sequence feature of the device illustrated in FIG. 3 is depicted graphically in FIG. 4. In FIG. 4, the horizontal axis represents time, while the vertical axis represents the quantity of nicotine absorbed into a given draft of air taken through the cigarette. As the graph shows, a sequence of drafts on the cigarette over a relatively short time period will produce a decreasing amount of nicotine with each draft, thereby limiting the total amount of nicotine inhaled within the simulated smoking of one conventional cigarette. If the device is then allowed a resaturation period during which no air is drawn, a subsequent series of drafts will produce approximately the same total quantity of nicotine, thereby simulating the smoking of a second conventional cigarette.

The parameters of the particular sequence of nicotine absorption which will be provided in each draft may be adjusted by selecting the appropriate dimensions for the structure of the device 10. The length and diameter of the central passageway 50, the degree of saturation of the absorbent member 56 with the nicotine mixture, and the porosity or saturation equilibrium rate of the material used for the absorbent member 56 all will affect the amount of nicotine obtained in a given draft within a series of drafts, and the time required for resaturation of the central volume 58. Furthermore, the central volume 58 may be manufactured from a material having a different porosity than the remainder of the absorbent member 56 in order to further control the regulating feature of this embodiment of the cigarette substitute 10.

FIG. 5 illustrates a fourth embodiment of the invention in a cross sectional side elevation. The device 10 shown in FIG. 5 is similar to that shown in FIG. 3, and like that of FIG. 3 includes a container 12, first and second tapered sidewalls 46 and 52, and a central passageway 50. Additionally provided in this embodiment, however, is an annular divider 64, which is joined at its outer circumference to the inner wall of the container 12 and which coincides at its inner circumference with the central passageway 50. Disposed on one side of the annular divider 64 is a first absorbent member 66, while a second absorbent member 68 is similarly disposed on the other side of the divider. In this manner, two separate absorbent regions are provided in the device of FIG. 5. In some combinations, the various components which conceivably might be added to the nicotine mixture utilized in the cigarette might be incompatible. For example, different components might chemically react to produce undesirable by-products, or multiple components might have differing evaporation rates, so that if they were combined, a suitable amount of one of the components might not be adequately evaporated. By providing the annular divider 64 and two absorbent members 66 and 68, the device shown in FIG. 5 provides for appropriate adjustments to be made to permit the use of such incompatible mixtures. One manner in which the device 10 may be adjusted for such incompatible mixtures is by providing first absorbent member 66 made of a material having a different porosity than the material of second absorbent member 68. Thus, for example, if the mixture which is to be placed within the second absorbent member 68 has a significantly lower evaporation rate than the mixture to be placed in the first absorbent member 66, the second absorbent member 68 may be composed of a material having a higher porosity, so that the mixture therein may more readily evaporate into the air drawn through the central passageway 50.

The structure of the device 10 also is arranged to provide for a second means of adjustment. Assuming the same conditions, i.e., a mixture within the second absorbent member 68 having a relatively low rate of evaporation, the annular divider 64 may be placed relatively closer to the intake 54 of the central passageway and relatively further away from the exit 48. In this manner, the surface area of the central passageway 50 which is exposed to the second absorbent member 68 is greater than the surface area of the central passageway 50 exposed to the first absorbent member 66. Consequently, a proportionately greater amount of the mixture within the second absorbent member 68 will be exposed to the airstream passing through the central passageway when a draft is taken on the cigarette, thereby equalizing the overall quantities of the first and second mixtures which are absorbed.

As will be appreciated by those skilled in the art, the self-regulating feature discussed in connection with the embodiment disclosed in FIG. 3 is also applicable to the embodiment illustrated in FIG. 5.

Although a typical embodiment of the present invention has been illustrated and discussed herein, numerous modifications and alternative embodiments of the apparatus and method of this invention will be apparent to those skilled in the art in view of this description. Accordingly, this description is to be construed as illustrative only and is provided for the purpose of teaching those skilled in the art the manner of constructing the apparatus and performing the method of the invention. It is to be understood that the forms of the invention shown and described herein are to be considered as the presently preferred embodiments. Various changes may be made in the configurations, sizes, and arrangements of the parts of the invention, as will be recognized by those skilled in the art, without departing from the scope of the invention. For example, equivalent elements might be substituted for those illustrated and described herein, parts or connections might be reversed or otherwise interchanged, and certain features of the invention might be utilized independently of the use of other features, all as will be apparent to one skilled in the art after receiving the benefit attained through reading the foregoing description of the invention.

What is claimed is:

1. A simulated smoking device for non-burning use, comprising:

a container defining a passageway therethrough;

an absorbent material disposed within said container and communicating with said passageway;

a nicotine-bearing material absorbed into said absorbent material;

and a constriction within said passageway formed by said absorbent material, said device being adapted to release nicotine vapors into air drawn through said passageway by the user of said device.

2. The device of claim 1, wherein said nicotine-bearing material is selected from the group consisting of:

nicotine (d), nicotine (l), nicotine (dl), nicotine salts, and nicotine esters.

3. The device of claim 1, wherein ingredients for flavoring and pH adjustment of said nicotine-burning material are also absorbed into said absorbent material.

4. The device of claim 3, wherein said flavoring ingredients are selected from the group consisting of:

orange flavoring, lemon flavoring, menthol, spearmint flavoring, peppermint flavoring, and cinnamon flavoring.

5. The device of claim 1, wherein water is also absorbed into said absorbent material in order to provide for the humidification of said vapors to reduce the drying effect or said vapors on the mouth of a user.

6. The device of claim 1, further comprising:

a first closure at a first end of said passageway; and a second closure at a second end of said passageway, said closures being adapted to prevent evaporation of said nicotine-bearing material when said device is not in use.

7. The device of claim 6, wherein each of said closures comprises:

a resilient flap affixed to said container, said flap adapted to seal said passageway when air is not drawn through said passageway by said user and adapted to permit the flow of air through said passageway when air is drawn through said passageway by said user.

8. The device of claim 1, further comprising:

a first moisture seal at a first end of said passageway; and a second moisture seal at a second end of said passageway.

9. The device of claim 8, wherein each of said seals comprises:

a porous plug disposed across said passageway, said plug being adapted to provide minimal resistance to the flow of gases therethrough and to substantially prevent the flow of liquids therethrough.

10. The device of claim 1, wherein said container is cylindrical in shape, having an outer diameter and a length selected to simulate the appearance of a conventional cigarette.

11. The device of claim 10, wherein said absorbent material comprises:

an absorbent cylinder having an external diameter corresponding to the inner diameter of said container.

12. The device of claim 10, wherein said absorbent material is recessed from the ends of said cylindrical container, thereby preventing contact between said member and the mouth of a user drawing air through said device.

13. The device of claim 10, further comprising:

a cylindrical band affixed around a first end of said cylinder, said band being adapted to simulate the appearance of a filter tip.

14. The device of claim 10, wherein said comprises:

a first tapered portion bounded by a first frustoconical sidewall and tapering inward from a first end of said container;

a second tapered portion bounded by a second frustoconical sidewall and tapering inward from a second end of said container; and a central cylindrical portion communicating between said first portion and said second portion, the sidewall of said central portion being defined by said absorbent member.

15. The device of claim 14, wherein the diameter and length of said central portion are selected to provide a predetermined rate of vapor release from said mixture.

16. The device of claim 14, further comprising:

an annular divider disposed within said central portion; and wherein said absorbent material comprises:

a first absorbent material disposed on a first side of said divider; and a second absorbent material disposed on a second side of said divider;

said first and second absorbent members adapted to have separately absorbed therein a pair of compounds having incompatible characteristics.

17. The device of claim 16, wherein said divider is longitudinally positioned within said cylinder to control the relative amounts of surface area of said first and second absorbent materials exposed to said passageway, thereby controlling the relative amounts of vapor released from said first and second absorbent materials.

18. The device of claim 16, wherein the relative porosities of said first and second absorbent materials are selected to control the relative amounts of vapor released from said first and second members.

19. A simulated smoking device which is adapted for non-heating or non-combustion uses, comprising:

a container defining a passageway therethrough;

means containing a source of vaporizable nicotine, said means disposed within the container, and providing for the reduction of pressure of air drawn through the passageway;

said source being capable, when the device is not heated above ambient room temperature and in the absence of combustion, or releasing significant amounts of nicotine vapors into air drawn through said passageway by the user of said device.

20. The device of claim 19 wherein said source of vaporizable nicotine is capable, in the absence of tobacco, of releasing nicotine vapors into air drawn through said passageway.

21. The device of claim 20 wherein said nicotine is selected from the group consisting of nicotine (d), nicotine (l), nicotine (dl), nicotine salts, and nicotine esters.

22. The device of claim 21 wherein the ingredients for flavoring and pH adjustment of said nicotine are also included with said source.

23. The device of claim 22 wherein said flavoring ingredients are selected from the group consisting of orange flavoring, lemon flavoring, menthol, spearmint flavoring, peppermint flavoring and cinnamon flavoring.

24. The device of claim 23 wherein water is also included with said source of vaporizable nicotine in order to provide for the humidification of said vapors to reduce the drying effect of said vapors on the mouth of the user.

25. The device of claim 19, 20, 21, 22, 23 or 24, wherein said source of vaporizable nicotine comprises an absorbent material having nicotine absorbed therein.

26. The device of claim 19 further comprising:

a first moisture seal at a first said passageway; and a second moisture seal at a second end of said passageway.

27. The device of claim 26 wherein each of said seals comprises:

a porous plug disposed across said passageway, said plug being adapted to provide minimal resistance to the flow of gases therethrough and to substantially prevent the flow of liquid therethrough.

28. The device of claim 19, further comprising:

a first closure at a first end of said passageway; and a second closure at a second end of said passageway, said closures being adapted to prevent the vaporization of said nicotine from said source of vaporizable nicotine when said device is not in use.

29. The device of 28 wherein each of said closures comprises:

a resilient flap affixed to said container, said flap adapted to seal said passageway when air is not drawn through said passageway by said user and said flap is adapted to permit the flow of air through said passageway when air is drawn through the passageway by the user.

30. A simulated smoking device which is adapted for non-heated or non-combustion use, comprising:

a container defining a passageway therethrough;

means containing a source of vaporizable nicotine, said means disposed within the container, and providing for the reduction of pressure of air drawn through the passageway;

means for preventing the evaporation of said nicotine during periods of non-use of said device;

during use, at ambient temperatures and pressures, said device capable of releasing nicotine into air drawn through said passageway by the user.

31. The device of claim 30 wherein said source of vaporizable nicotine comprises an absorbent material having absorbed therein a nicotine material selected from the group consisting of nicotine (l), nicotine (d), nicotine (dl), nicotine salts and nicotine esters.

32. The device of claim 30 wherein said nicotine is pH adjusted.

33. The device of claim 29 wherein said means comprises a first flap on a first side of said passageway;

a second flap on a second side of said passageway;

said flaps preventing the evaporation of nicotine when said device is not in use but, in use, permitting nicotine to be evaporated into air drawn through said passageway.

34. A simulated cigarette, which is adapted for non-heated or non-combustion use, comprising:

a container defining a passageway therethrough and having a mouthpiece;

means containing a source of vaporizable nicotine, said means disposed within the container, and providing for the reduction of pressure of air drawn through the passageway;

means for preventing the evaporation of said nicotine during periods of non-use of said device;

a user of said device by putting said mouthpiece in the mouth and sucking and realizing a discernible pressure drop, causing nicotine to be vaporized into air drawn through said passageway.

* * * * *

UNITED STATES PATENT AND TRADEMARK OFFICE

CERTIFICATE OF CORRECTION

PATENT NO. : 4,284,089

DATED : August 18, 1981

INVENTOR(S) : Jon P. Ray

It is certified that error appears in the above-identified patent and that said Letters Patent are hereby corrected as shown below:

Claim 5, column 12, line 14, delete the word "or" and insert therefor the word --of--.
Claim 14, column 12, line 58, insert the words --passage way-- between the word "said" and the word "comprises".
Claim 15, column 13, line 3, delete the word "mixture" and insert therefor the word --material--.
Claim 16, column 13, line 12, delete the word "members" and insert therefor the word --materials--.
Claim 19, column 13, line 36, delete the word "or" and insert therefor the word --of--.
Claim 26, column 13, line 64, insert therefor the words --end of-- between the word "First" and the word "said".
Claim 33, column 14, line 44, delete the word "side" and insert therefor the word --end--.
Claim 33, column 14, line 45, delete the word "side" and insert therefor the word --end--.

Signed and Sealed this

*Eleventh* Day of *February 1986*

[SEAL]

*Attest:*

DONALD J. QUIGG

*Attesting Officer*

*Commissioner of Patents and Trademarks*